United States Patent [19]
Cooke et al.
[11] 4,210,252
[45] Jul. 1, 1980

[54] ANGLEWORM STORAGE BOX

[75] Inventors: John P. Cooke, Minneapolis; Walter Rohrbach, Burnsville, both of Minn.

[73] Assignee: Inventors Products, Inc., Chaska, Minn.

[21] Appl. No.: 937,445

[22] Filed: Aug. 28, 1978

Related U.S. Application Data

[63] Continuation of Ser. No. 810,931, Jun. 29, 1977, abandoned.

[51] Int. Cl.[2] ..... B65D 7/00; B65D 21/02
[52] U.S. Cl. ..... 220/4 F; 220/334; 206/511; 206/512
[58] Field of Search ..... 220/4 F, 76, 334; 206/511, 512, 509, 508

[56] References Cited

U.S. PATENT DOCUMENTS

| | | | |
|---|---|---|---|
| 3,407,961 | 10/1968 | Box | 206/511 |
| 3,528,583 | 6/1968 | Taylor | 220/4 F |
| 3,651,977 | 3/1972 | Morgan | 206/512 X |
| 3,955,702 | 5/1976 | Lundy | 220/4 F |
| 3,966,084 | 6/1976 | Box | 220/334 X |
| 3,966,285 | 6/1976 | Porch et al. | 220/4 F X |
| 4,050,604 | 9/1977 | Flanders | 220/4 F |

*Primary Examiner*—Steven M. Pollard
*Attorney, Agent, or Firm*—Schroeder, Siegfried, Ryan, Vidas, Steffey & Arrett

[57] ABSTRACT

An angleworm storage box comprised of a pair of rigid, integrally formed rectangular frame members which are right angled in cross-section and are connected by a set of corner struts, also right angled in cross-section, and having latch members extending outwardly from their ends which are thrust through apertures defined by elastic materials in the corner portions of the two frames, the frames and struts being molded of rigid plastic material and the portions adjacent the aperture-defining portions being relieved to cause the aperture-defining portions to be more elastic in order to permit the relatively large end portions of the latch elements to pass therethrough and thereafter latch thereagainst to create a rigid, simple and inexpensive box framework. Foot members carried at each corner of the bottom frame are so designed as to nest with the cover member for the box. Simple, unique but highly effective latch means is carried entirely by the cover for the box. Fiberboard end, bottom and side panels are pressed into place in snug fitting relation within the framework and a cover panel covers a central opening within the cover.

1 Claim, 8 Drawing Figures

ANGLEWORM STORAGE BOX

This is a continuation of application Ser. No. 810,931, filed June 29, 1977, now abandoned.

This invention relates to bait containers. More particularly, it relates to containers for the storage of angleworms and the like.

It is a general object of our invention to provide a novel and improved angleworm storage box of simple and improved construction.

A more specific object is to provide a novel and improved angleworm storage box which is of simple, inexpensive and rigid construction which is quick and easy to assemble.

Another object is to provide a novel and improved angleworm storage box which can be manufactured and shipped in knocked-down condition in small compass and inexpensively, and can be readily and easily assembled with a minimum of expenditure of time.

Another object is to provide a novel and improved angleworm storage box which provides maximum strength and rigidity and yet is manufactured from relatively inexpensive materials.

Another object is to provide a novel and improved angleworm storage box having a cover member which has an improved latch means and which readily nest for stacking with another and similar box as a result of its unique construction.

These and other objects and advantages of invention will more fully appear from the following description, made in connection with the accompanying drawings, wherein like reference characters refer to the same or similar parts throughout the several views, in which.

Figure 1:
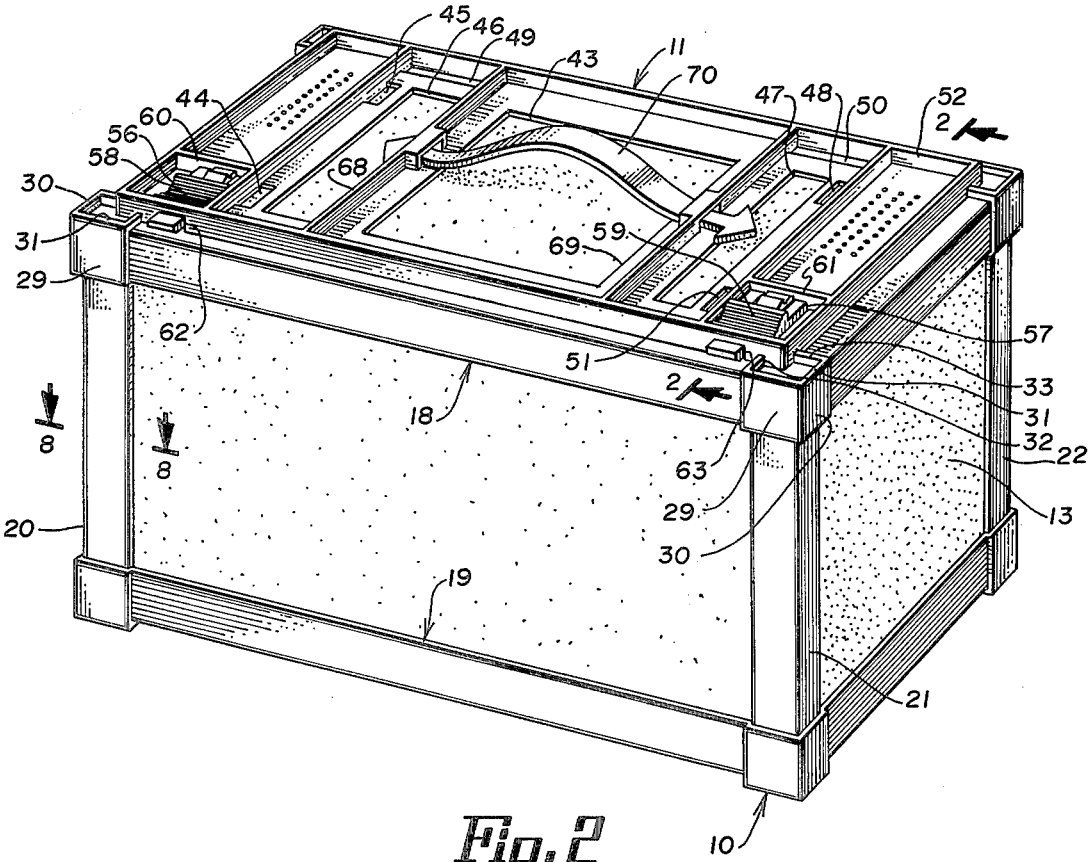
FIG. 1 is a perspective view of the preferred embodiment of our invention.

The preferred embodiment of our invention as shown in FIGS. 1–8 is comprised of a rigid plastic framework indicated generally by the numeral 10 and consisting of a cover member 11, end panels 12 and 13, side panels 14 and 15, a bottom panel 16 and a top panel 17. The rigid framework is comprised of a rigid planar rectangular top frame indicated generally by the numeral 18, a rigid planar integrally formed bottom frame 19 and four corner struts, three of which are shown and identified by the numerals 20–22, inclusive.

The top frame 18, as well as the bottom frame 19 is integrally molded of a rigid plastic material, as are the corner struts 20–22. The top frame 18 and 19 are identical in structure but are inverted with respect to each other when the corner struts are placed into connecting position and latched thereto to provide the rigid framework 10.

The top frame 18 is comprised of a horizontal panel strip 23 which defines a central opening 24. Extending downwardly from the outer peripheral portions of the panel strips 23 is a vertically depending flange 25. As will be readily seen, the horizontal panel strips 23 define an open rectangle and the depending flanges 25 comprise a continuous skirt depending from the peripheral portions thereof. At each corner of the rectangle defined by the horizontal panel strips 23 there is provided a pair of elongated latch apertures, best seen in FIG. 4, these apertures being oriented at right angles to each other and identified by the numerals 26, 27. An L-shaped recess 28 is formed in the upper surface of the horizontal panel strip 23 adjacent to the two latch apertures as clearly shown in FIG. 4 to provide an upstanding elastic wall, or rib, 29 which thereby defines one side of its associated aperture. In other words, by relieving the material along the L-shaped design, as shown at 28, a thin web **28*a* of upstanding plastic material is left to define the major portion of one side wall of the apertures 26 and 27**, thereby providing sufficient elasticity to the opening-defining portions to permit the corner sruts to be latched thereto, as will be hereinafter explained.

It will be noted that the depending flange 29 at each corner of the frames is disposed slightly outwardly of the plane of the depending flanges at the adjacent side and end. This can be readily seen in FIG. 1 and such portions are identified by the numerals 29 and 30. The frames are molded so that the inner surfaces of these portions 29 and 30 are in the same plane as the outer surfaces of the side and end flanges which depend from the peripheral portions of the panel strips intermediate the corners. This provides a recess at the interior surfaces of the corners to accommodate the corner struts so that the inner surface of the latter will be flush with that of the side and end flanges intermediate the corners.

An upward extension of the corner flanges 29 and 30 defines an upstanding wall or rib 31 which surround the apertures. The innermost corner of this wall or rib 31 is relieved to provide abutments 32 and 33 at each of the corners to embrace and locate each corner of the cover member 11.

The bottom frame 19 is of the same construction as the top frame 18, but when assembled, it is inverted so that the wall or rib 31 constitutes a foot for the assembled box and the abutments 32 and 33 provide locating abutments for the cover member of a similarly constructed box to thereby provide a nesting feature as clearly shown in FIG. 7, the upstanding surrounding wall of the cover member 11 (as will be hereinafter described) fitting snugly within the rectangular area defined by the pair of abutment members 32, 33 at each of the lower corners.

Figure 2:
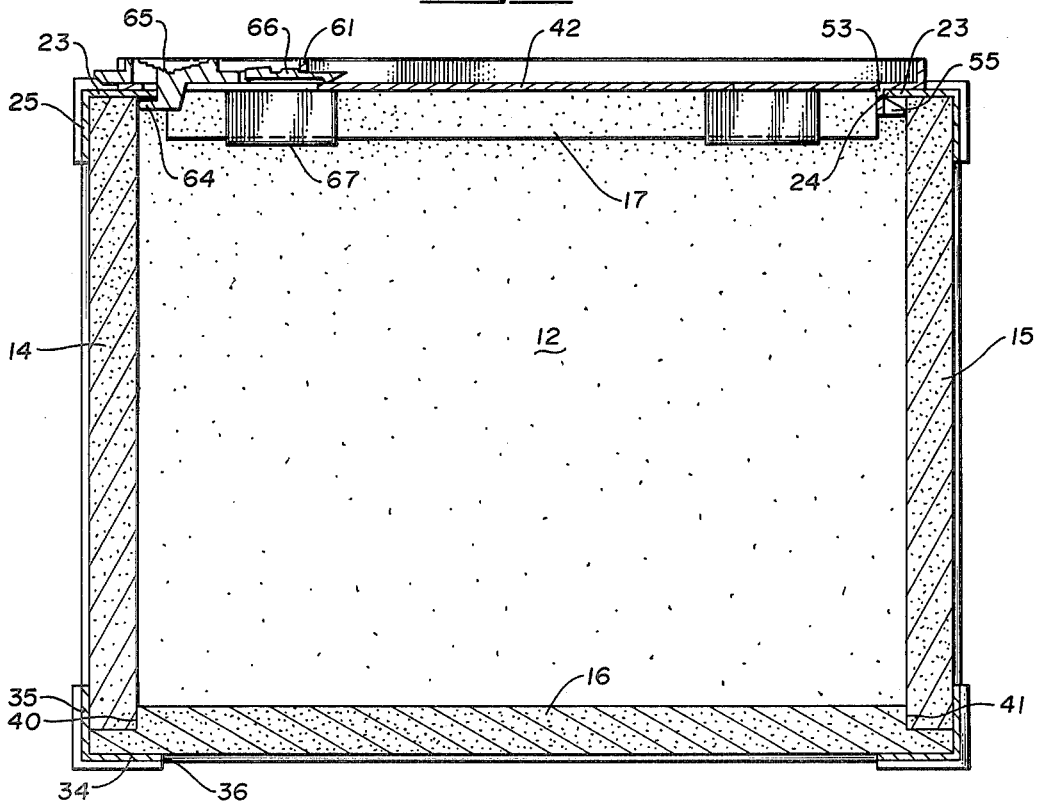
FIG. 2 is a vertical sectional view taken along line 2—2 of FIG. 1.

By reference to FIG. 2, it will be seen that the bottom frame 19 has horizontal panel strips 34 and flange members 35 extending at right angles thereto but, since the frame has been inverted, such flanges now extend upwardly from the horizontal panel 34. The horizontal panel strips 34 likewise define a central opening 36. Since the construction of the bottom frame is identical to that of the top frame, latch apertures 26 and 27 are similarly disposed within each corner portion of the bottom frame and are provided with similar elastic aperture-defining walls, or ribs 28.

Figure 6:
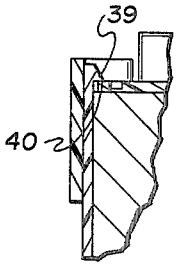
FIG. 6 is a fragmentary sectional view taken along line 6—6 of FIG. 4.
Figure 8:
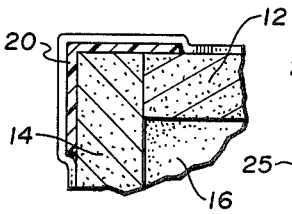
FIG. 8 is a vertical secitonal view taken along line 8—8 of FIG. 1.
Figure 5:
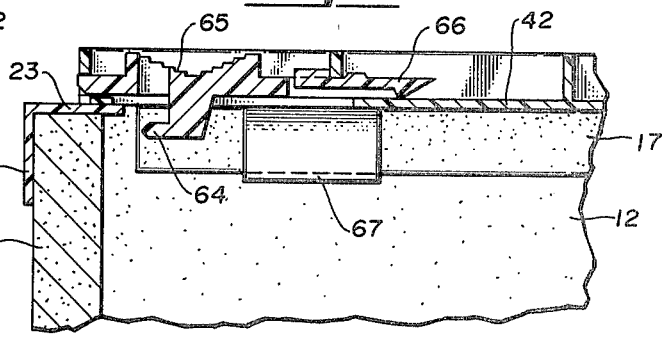
FIG. 5 is a fragmentary sectional view taken along line 5—5 of FIG. 4.
Figure 4:
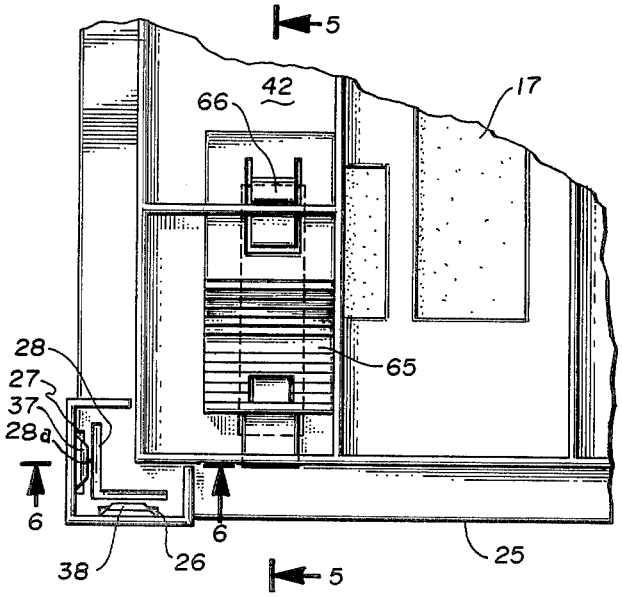
FIG. 4 is a fragmentary plan view of the left front corner of the box shown in FIG. 1.

The four corner strut members 20–22 (one not shown) are each right angled in cross-section, each leg of the angle having a pair of latch elements extending longitudinally outwardly from the opposite ends thereof. These latch elements 37,38 can best be seen in FIGS. 4 and 6. By reference to FIG. 4, it will be seen that each of the latch members 37,38 is narrower than the associated latch aperture but is thicker than the transverse dimensions of the aperture. To facilitate insertion of the latch elements, each is provided with a beveled surface 39, as shown in FIG. 6. A latching surface 40 extends at right angles to the length of the latching element so that when the elements are forced through the latching apertures, the elastic wall 28 yields sufficiently to permit the latching head to be forced therethrough and as soon as it protrudes above the upper surface of the horizontal panel, it snaps into latching position as shown in FIG. 6. When this has been accomplished at each of the corners of the top and bottom frame, the result is a rigid framework 11 which is adapted to receive the panels and cover member as hereinafter described.

Figure 3:
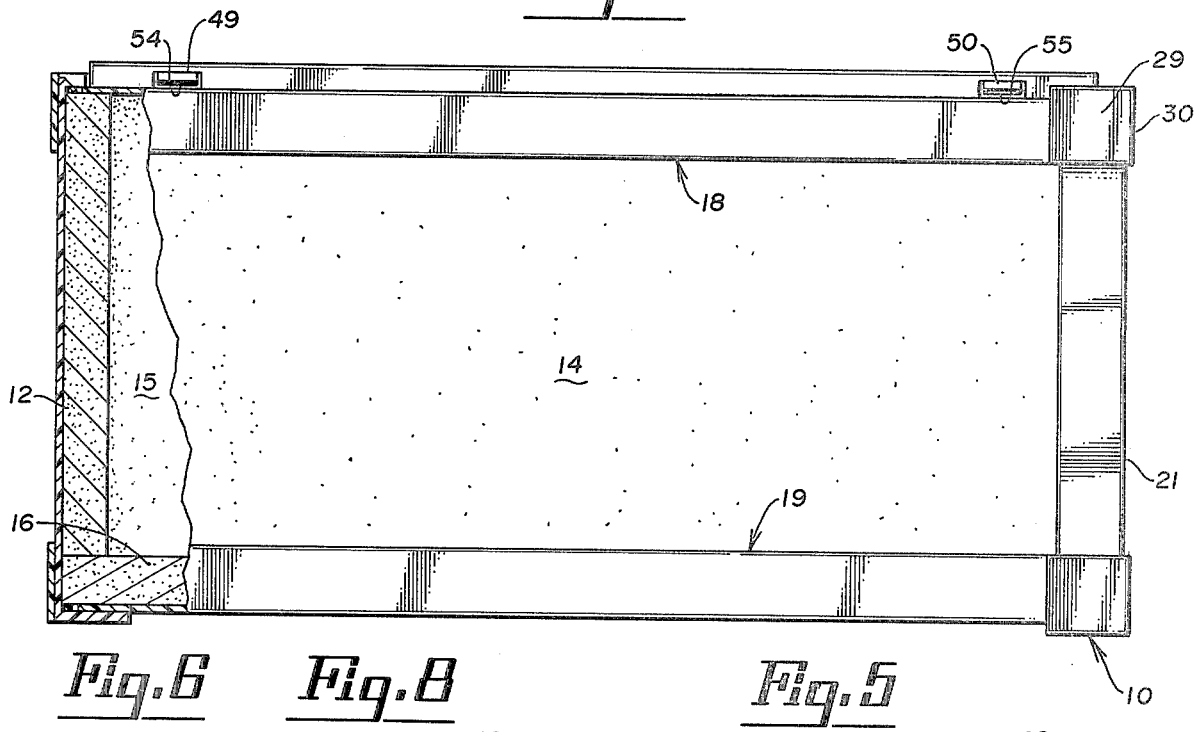
FIG. 3 is a front elevational view of our angleworm storage box with portions thereof broken away to more clearly illustrate its construction.

When the framework 11 has been assembled, as described above, the bottom panel 16 which is of dimensions sufficient to make it a snug fit within the bottom frame 19, is placed in position, as shown in FIG. 3. Each of its ends abut against the upstanding flanges at the ends and sides of the bottom frame to provide a snug fit. The bottom panel is relieved at each of its sides to a depth of approximately one-half of its thickness, as shown in FIG. 2, and identified by numerals 40 and 41, the recess being of a width equal to the thickness of the side panels 14 and 15, which are moved into place as shown in FIG. 2 after the end panels are placed into position with the bottom edges thereof resting upon the bottom panel 16. The outer surface of the end panels at their top and bottom bear against the flanges carried by the peripheral portions of the top and bottom frames 18 and 19, since the thickness of the bottom panel is less than the height of the upstanding flanges of the bottom frame 19. The ends of the end panels 12 and 13 bear against the leg of its associated corner strut which extends along the side panel of the box.

It will be noted that the side panels 14 and 15 bear against depending side flanges of the top frame 18 with their ends abutting against the end panels to again provide a snug fit and that the lower edges extend downwardly into the recesses 40,41 of the bottom panel. The side panels 14 and 15 are moved into position last in the assembly of the panels of the box.

The cover member 11 is likewise formed of molded plastic material and has a horizontal top panel 42 which defines a central opening 43, as shown in FIG. 1, and a plurality of other rectangular openings identified by the numerals 44-51, inclusive. Extending upwardly from the panel 42 at its peripheral edge portions is a rectangular upstanding wall 52. Disposed inwardly a short distance from its peripheral edge and depending from the lower surface of the panel 42 is a flange member which extends parallel to the edge of that panel along each end and along the back side thereof, the forward side being open. The dimensions of this flange 53 are equal to the dimensions of the central opening of the upper frame 18 so as to ensure that the cover will fit snugly in position when applied thereto. Carried by the flange 53 and extending rearwardly therefrom directly opposite each of the openings 49 and 50 is a beveled pivot block 54, 55. These pivot blocks serve to anchor the back side of the cover member 11 and provide a pivot therefor about which the cover member may move when it is raised from closed to open position since they extend beneath the horizontal panel strip of the backside of the top frame 18 to anchor that side of the cover member when it is in latched position.

At each of the forward corners of the cover member 11, there is provided a pair of elongated latch apertures 56 and 57 within which the latch 58, 59 may shift between locked and unlocked positions. An upstanding transverse rib 60, 61 extends between the wall 52 and a parallel rib and is provided with an opening within which the latch members 58 and 59 are guided at their rear ends. A small opening in the front panel of the wall 52 in front of the latch members permits the forward ends thereof to likewise be guided, as shown at 62 and 63. It will be seen that the openings at 62 and 63 and the openings in the two transverse ribs 60, 61 provide guides for the two latch elements as they are moved forwardly and rearwardly between locked and unlocked positions respectively.

Each of the latch members are identical in construction and can best be seen in FIG. 2. Each is provided with a depending latch element 64 and a thumb recess 65. Each likewise has a rearwardly extending resiliently mounted latch retainer 66 which, when released, engages the transverse rib or wall through which it extends in either one of the two positions shown in FIG. 2 and FIG. 5 and which, when depressed, permits the latch to be shifted longitudinally to the opposite position and upon its release, secures the latch member thereat.

Carried by the underside of the panel 42 of the cover member 11 is a plurality of L-shaped, depending brackets indicated by the numeral 67. These brackets are mounting brackets for the insulation top panel 17 which is slid from the forward edge of the cover rearwardly within the four brackets until it bears against the inner surface of the depending wall 53, as best shown in FIG. 2.

As best seen in FIG. 1, a pair of parallel upstanding ribs 68 and 69 are carried by the cover member and provided with opposite openings through which a plastic carrying handle 70 extends, the latter having enlarged head portions which serve to anchor the handle to the ribs after the ends thereof have been thrust through the opening.

From the above, it will be seen that we have provided a novel and improved angleworm storage box which is very inexpensive to manufacture, distribute and assemble. Moreover, it is rigid and provides an excellent container for bait such as angleworms, the insulation board having a wood fiber base commonly used in the construction industry for sound deadening qualities. Such board which is commonly referred to as fiber board is porous and absorbs and holds moisture and yet facilitates evaporation so as to maintain the interior of the box relatively cool. The type of insulation board which we utilize may be purchased from Boise-Cascade Company of International Falls, Minnesota, and is identified as ½" "Soundboard". The top and bottom frames 18 and 19 and the corner struts are molded of high impact styrene.

Figure 7:
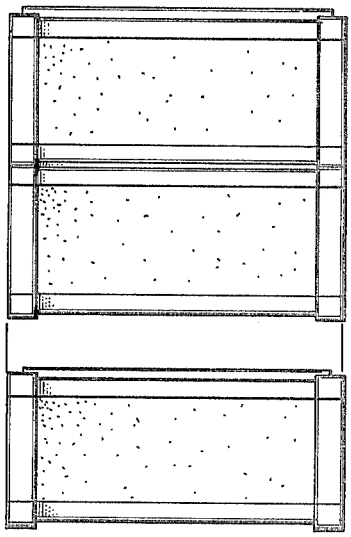
FIG. 7 is a front elevational view of a plurality of our angleworm nesting boxes illustrated in nested relation.

It will be noted that a plurality of our angleworm storage boxes may be readily stored in nested position, as shown in FIG. 7. It will also be noted that the entire framework 11 is formed from pieces requiring only two separate dies. Moreover, once the framework is assembled, it is positively locked together so that it will not come apart during usage or storage even though the insulation panels were to be removed, or new ones substituted therefor.

It will, of course, be understood that various changes may be made in the form, details, arrangement and proportions of the parts without departing from the scope of our invention which consists of the matter shown and described herein and set forth in the appended claims.

We claim:

1. An angleworm storage box consisting of a closed imperforate container and comprised of:

(a) a planar integrally formed rectangular skeleton top frame having a central unobstructed major opening and a horizontal panel strip with outer peripheral edge portions and a vertically extending flange depending from said outer edge portions at each of its sides and ends;

(b) said panel strip surrounding said central opening;

(c) a planar integrally formed rectangular skeleton bottom frame having the same critical dimensions as said top frame and having a central unobstructed major opening and a horizontal bottom panel strip with outer peripheral edge portions and a flange extending upwardly from said outer edge portions at each of its sides and ends;

(d) each of said horizontal panel strips having corner portions with vertically extending latch apertures extending therethrough, at least some of the aperture-defining portions of said panel strips being comprised of elastic material;

(e) a plurality of separate non-tubular corner strut members, one each of which extends between each pair of corresponding corners of said top and bottom frames, each of said strut members being generally angular in cross-section and comprising a pair of elongated legs extending substantially normal to each other, each of said legs having interior surfaces facing toward each other and having latch elements at each of its opposite ends extending longitudinally outwardly therefrom into said latch apertures of its said associated corner and through its respective horizontal panel strip and latching itself thereto to comprise therewith a rigid rectangular skeleton box framework;

(f) substantially imperforate side, end, top and bottom panels separate from said frames and said strut members carried snugly against the interior surfaces of said elongated legs of said framework and of said strut members and readily removable therefrom and covering said openings and extending between said strut members and said frames and comprising therewith a closed generally rectangular box adapted to receive and retain earthworms therewithin;

(g) a cover member secured to said top frame and closing said central opening;

(h) said cover member having an elongated rib depending from its under surface and defining a generally rectangular configuration conforming to said central opening and extending downwardly thereinto;

(i) securing means carried by said rib and extending outwardly therefrom beneath said horizontal panel strip at one side of said framework to secure said cover at one of its sides thereto for relative pivotal movement;

(j) said cover member also having upstanding rib structure extending upwardly from the upper surface thereof and having openings therein defining a latch keeper;

(k) a latch member slidably mounted within said latch keeper and constructed and arranged to latchably engage the underside of the opposite horizontal panel strip of said upper frame to secure said cover member in closed position; and (l) said latch member including a flexibly mounted latch-securing tongue constructed and arranged to extend through said latch keeper and engage the same in a plurality of positions to alternatively hold said latch member in cover-securing and cover-releasing positions as desired.

* * * * *